US009969158B2

(12) United States Patent
Stark et al.

(10) Patent No.: US 9,969,158 B2
(45) Date of Patent: May 15, 2018

(54) ELECTROSPRAY EMITTER AND METHOD OF MANUFACTURE

(75) Inventors: John Stark, London (GB); Mark Richard Shepherd, Royston (GB)

(73) Assignee: QUEEN MARY & WESTFIELD COLLEGE, London (GB)

( * ) Notice: Subject to any disclaimer, the term of this patent is extended or adjusted under 35 U.S.C. 154(b) by 792 days.

(21) Appl. No.: 13/508,645

(22) PCT Filed: Nov. 11, 2010

(86) PCT No.: PCT/GB2010/002085
§ 371 (c)(1),
(2), (4) Date: Aug. 3, 2012

(87) PCT Pub. No.: WO2011/058320
PCT Pub. Date: May 19, 2011

(65) Prior Publication Data

US 2012/0291702 A1 Nov. 22, 2012

(30) Foreign Application Priority Data

Nov. 11, 2009 (GB) ..... 0919744.3

(51) Int. Cl.

| | |
|---|---|
| ***B05B 5/025*** | (2006.01) |
| ***B41J 2/06*** | (2006.01) |
| ***B05B 5/053*** | (2006.01) |
| *B05B 1/14* | (2006.01) |

(52) U.S. Cl.
CPC ..... *B41J 2/06* (2013.01); *B05B 5/0255* (2013.01); *B05B 5/0533* (2013.01); *B05B 1/14* (2013.01); *B41J 2002/061* (2013.01)

(58) Field of Classification Search
None
See application file for complete search history.

(56) References Cited

U.S. PATENT DOCUMENTS

| | | | | |
|---|---|---|---|---|
| 6,158,844 | A * | 12/2000 | Murakami et al. | 347/55 |
| 2002/0003177 | A1 | 1/2002 | O'Connor et al. | |
| 2002/0007869 | A1 | 1/2002 | Pui et al. | |
| 2002/0122099 | A1* | 9/2002 | Furukawa | B41J 2/06 347/55 |
| 2003/0111599 | A1* | 6/2003 | Staats | 250/288 |

(Continued)

FOREIGN PATENT DOCUMENTS

| | | |
|---|---|---|
| EP | 1698465 A1 | 9/2006 |
| EP | 1963024 | 12/2006 |

(Continued)

OTHER PUBLICATIONS

European Patent Office, European Examination Report in Application No. 10 778 705.3-1760, dated Sep. 30, 2013.

*Primary Examiner* — Binu Thomas
(74) *Attorney, Agent, or Firm* — Morris & Kamlay LLP

(57) ABSTRACT

An electrospray emitter (10) for emitting a liquid comprising a sheet (40) having a channel (65) opening to an aperture (55) on a flat emitter surface extending across the sheet (40). A charging electrode (80) coupleable to an electrical supply and arranged to apply an electrical charge to liquid passing into the channel (65). A control electrode (50) proximal to the channel (65) for controlling electrospray emission, that may be embedded in the sheet. A non-wetting or insulating layer (30) may be applied to the sheet.

9 Claims, 9 Drawing Sheets

(56) References Cited

U.S. PATENT DOCUMENTS

| | | | | |
|---|---|---|---|---|
| 2003/0146757 | A1* | 8/2003 | Aguero et al. | 324/453 |
| 2004/0001134 | A1* | 1/2004 | Nakazawa et al. | 347/101 |
| 2004/0206399 | A1 | 10/2004 | Heller et al. | |
| 2005/0041067 | A1* | 2/2005 | Aoshima | 347/55 |
| 2006/0097151 | A1 | 5/2006 | Seaward et al. | |
| 2006/0214989 | A1* | 9/2006 | Furukawa | B41J 2/06 347/47 |
| 2006/0244786 | A1* | 11/2006 | Onozawa | 347/55 |
| 2009/0056133 | A1* | 3/2009 | Waits et al. | 29/890.143 |
| 2009/0189952 | A1* | 7/2009 | Lee et al. | 347/45 |

FOREIGN PATENT DOCUMENTS

| | | | |
|---|---|---|---|
| EP | 2162228 | | 5/2008 |
| EP | 1797961 | | 9/2010 |
| JP | 11042784 | A | 2/1999 |
| JP | 2004136653 | | 4/2004 |
| JP | 2004/136656 | | 5/2004 |
| TW | 200523123 | A | 7/2005 |
| WO | 2000/015321 | | 3/2000 |
| WO | 2000/052455 | | 9/2000 |
| WO | 2005/021269 | | 3/2005 |
| WO | 2005/021269 | | 10/2005 |
| WO | 2006/009854 | | 1/2006 |
| WO | 2007/066122 | | 6/2007 |

* cited by examiner

ELECTROSPRAY EMITTER AND METHOD OF MANUFACTURE

FIELD OF THE INVENTION

The present invention relates to electrospraying and in particular an electrospray emitter and an array of electrospray emitters.

BACKGROUND OF THE INVENTION

Electrospray occurs when the electrostatic force on the surface of a liquid overcomes surface tension. Under certain conditions, a Taylor cone is created at the emitter of an electrospray device. A liquid jet may be emitted from the apex of the Taylor cone.

Electrospray devices may be formed from glass or metal capillaries fed by a reservoir. Such devices are described in WO2007/066122. However, electrospray devices based on capillaries may be difficult to manufacture, handle and clean or to manufacture in large numbers.

Therefore, there is required an electrospray emitter that overcomes these problems.

SUMMARY OF THE INVENTION

In accordance with a first aspect of the present invention there is provided an electrospray emitter for emitting a liquid comprising:

a sheet having a channel opening to an aperture on a flat emitter surface extending across the sheet;

a charging electrode coupleable to an electrical supply and arranged to apply an electrical charge to liquid passing into the channel; and a control electrode proximal to the channel for controlling electrospray emission. This provides an electrospray emitter that may be cleaned more easily and that may be more robust. The sheet may be a substrate that is flat, substantially flat or alternatively, curved. The flat emitter surface may be featureless or absent of protrusions or nozzles. The aperture may be in the plane of the sheet or in the plane of the emitter surface. This improves its ability to be cleaned effectively and reduces the build-up of dirt and debris. The aperture may also be level with the surface or recessed.

Optionally, the control electrode may be separated from the emitter surface. The emitter surface is the side of the device from which electrospray occurs. This surface may be prone to dirt, contaminants or wetting by the liquid. It may be beneficial to have the control electrode on or near the emitter surface to improve control or the device. However, there may also be benefits in locating the control electrode away from the emitter surface to keep it clean or away from contaminants.

Optionally, the control electrode at least partially surrounds the channel. For instance, this may be in the form of a full or partial ring around the channel. However, other shapes or configurations may be used.

Optionally, the control electrode is embedded in the sheet. Embedding the control electrode in the sheet may further protect it or make the device easier to manufacture using fabrication techniques used in the semiconductor industry. Therefore, the surface receiving the emitted liquid can have a floating potential and does not have to be part of the electrical circuit or earthed. Embedding the control electrode may be achieved by covering it with another layer (e.g. an insulating layer) or fully enclosing it within the sheet. Embedding also includes partially seating the control electrode within the material of the sheet and/or placing it level with or behind the aperture, opening or exit from which liquid is emitted from the channel.

Optionally, the electrospray emitter may further comprise an insulating or non-wetting or liquid repellent layer on the emitter surface of the sheet. This non-wetting or liquid repelling layer may make the device easier to maintain and clean by repelling the liquid away from the aperture on the emitter surface. Preferably, the non-wetting or hydrophobic surface extends up to the aperture.

Optionally, the insulating or non-wetting or liquid repellent layer is a flouropolymer material. The flouropolymer may be for instance, Teflon from DuPont, Ethylene tetrafluoroethylene (ETFE) or Fluorinated Ethylene-Propylene (FEP). Other suitable materials may be used and may be chosen depending on the liquid to be electrosprayed. These alternative non-wetting layers may include but are not restricted to hydrophobic materials.

Optionally, the electrospray emitter may further comprise a guard electrode fixed to the emitter surface. The guard electrode may prevent cross-talk with neighbouring electrospray emitters formed on the same device. The guard electrode may be provided with a suitable voltage from the electrical supply or grounded.

Optionally, the guard electrode may surround or encircle the channel. The guard electrode may also surround or encircle the aperture.

Optionally, the non-wetting layer is between the guard electrode and the sheet and further wherein the non-wetting layer is exposed around the aperture. In effect there may be an aperture in the guard electrode, which may be formed as an otherwise complete planar or flat layer. This aperture in the guard electrode may be slightly larger than the aperture in the channel so that the non-wetting layer between the sheet and guard electrode is exposed. This configuration preserves the benefit of the non-wetting layer around the aperture and that of the guard electrode.

Optionally, the control electrode is separated from the channel. The control electrode may be formed abutting the channel or separate from it to avoid further directly charging the liquid flowing through the channel.

Optionally, the channel may taper towards the aperture on the emitter surface. In other words, the liquid entrance of the channel may be larger than the aperture at the emitter surface. Preferably, the diameter may change smoothly along the channel.

Optionally, the electrospray emitter may further comprise two or more channels each having a corresponding control electrode. There may be many more electrospray emitters on the device or formed on the sheet. Each electrospray emitter may be configured to emit the same or different liquids.

In accordance with a second aspect of the present invention there is provided an electrospray emitter for emitting a liquid comprising:

a sheet having a channel opening to an aperture on a flat emitter surface extending across the sheet; and a non-wetting or liquid repelling layer applied to the emitter surface of the sheet. The non-wetting layer may reduce fluid build-up around the aperture and so may help to keep the device clear. The sheet may be planar and may comprise a plurality of channels.

In accordance with a third aspect of the present invention there is provided an electrospray emitter for emitting a liquid comprising:

a sheet having a channel opening to an aperture on a flat emitter surface extending across the sheet;

a charging electrode coupleable to an electrical supply and arranged to apply an electrical charge to liquid passing into the one or more of the channels; and a guard electrode applied to the emitter surface. The guard electrode reduces cross-talk with nearby-by electrospray emitters. The guard electrode may be held (or varied with an appropriately defined time varying voltage waveform to reduce channel cross talk) at a suitable voltage or grounded. The sheet may be planar and may comprise a plurality of channels.

Optionally, the guard electrode may surround or encircle the channel or each channel for an array of electrospray emitters.

Optionally, the guard electrode is separated from the aperture on the emitter surface of the sheet.

Optionally, both the control electrode and the guard electrode may be embedded in the sheet, the guard electrode being separated from the control electrode by a non-conductive layer or area and the entire surface of the sheet being covered by a non-wetting layer or fluoropolymer film (save for the apertures).

In accordance with a fourth aspect of the present invention there is provided an electrospray emitter for emitting a liquid comprising:

a sheet having a channel opening to an aperture on a flat emitter surface extending across the sheet, the channel having a liquid supply entrance; and a charging electrode outside of the channel and coupleable to an electrical supply and arranged to apply an electrical charge to liquid passing into the channel, wherein the aperture is narrower than the liquid supply entrance of the channel. Preferably, the channel diameter may change smoothly along the channel. The sheet may be planar and may comprise a plurality of channels.

Optionally, the channel may be tapered.

In accordance with a fifth aspect of the present invention there is provided an array of the electrospray emitters formed from any of the electrospray emitters described above. It will be apparent that the optional or preferable features from each aspect of the invention may be readily used with any other aspect or embodiment.

In accordance with a sixth aspect of the present invention there is provided a method of manufacturing an electrospray emitter comprising the steps of: providing a sheet; channelling through the sheet to form a channel opening to an aperture on a flat surface extending across the sheet; providing a groove in the sheet proximal to the channel; partially filling the groove with a conductor to form an electrode; and sealing the electrode within the groove. Therefore the electrode may be embedded within the device. This reduces electrical breakdown. The groove may be partially or completely surrounding the channel. The channel may be cylindrical or conical or a mixture of both. A manifold may be provided as a liquid supply route for the channel.

Optionally, the groove and/or channel in the sheet may be provided by any of embossing, casting or injection moulding. This provides a simplified method of construction. Furthermore, the channel and groove may be made during the same manufacturing step.

Preferably, the sheet may be formed from a non-wetting material.

Optionally, the sheet may be formed from a lamination of a non-wetting material layer and a substrate layer. The non-wetting material may be a fluoropolymer material (e.g. FEP or similar). The substrate layer may be a plastics material, e.g. Kapton. The channel may be formed in conical form through the substrate layer but may be cylindrical through the non-wetting layer.

Optionally, the groove may be provided in the non-wetting material layer. The groove may stop at or before the interface between the non-wetting material layer and the substrate.

Optionally, the groove may be provided in the sheet on an opposite side to the aperture. In other words, the groove may be formed on the side of the sheet opposite the electrospray emission side and so embedded within the device away from any exposed surface in use.

In accordance with a seventh aspect there is provided method of manufacturing an electrospray emitter comprising the steps of: drilling one or more bore(s) through a substrate;

coating the substrate with a polymer photoresist layer filling the one or more bore(s); producing one or more channel(s) through the photoresist layer in the bore(s) using photolithography; and forming a manifold arranged to supply the channel(s) with liquid.

In accordance with an eighth aspect there is provided a method of manufacturing an electrospray emitter comprising the steps of: applying a pattern (circuit or other features) to a substrate using photolithography; coating the substrate with a polymer layer (for example a photoresist); ablating one or more channel(s) through the substrate and the polymer layer using the applied pattern as a mask; and forming a manifold arranged to supply the channel(s) with liquid.

The methods may be used to produce single, multiple or arrays of electrospray emitters.

Optionally, the methods of manufacturing may further comprise the step of applying a non-wetting layer around an opening of the channel(s). A metallic layer may also be applied to the channel(s) to act as an electrode.

In accordance with a ninth aspect there is provided an electrospray emitter or an array of electrospray emitters produced by any of the previously described methods of manufacture.

The methods of manufacturing may be used to produce any of the electrospray emitters described above.

It should be noted that any feature described above may be used with any particular aspect or embodiment of the invention.

BRIEF DESCRIPTION OF THE FIGURES

The present invention may be put into practice in a number of ways and embodiments will now be described by way of example only and with reference to the accompanying drawings, in which.

It should be noted that the figures are illustrated for simplicity and are not necessarily drawn to scale.

DETAILED DESCRIPTION OF THE PREFERRED EMBODIMENTS

Figure 1:
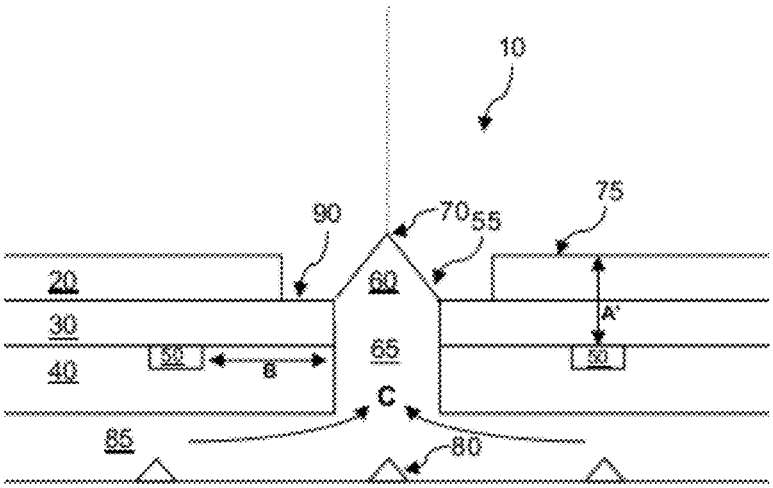
FIG. 1 shows a schematic diagram in cross-section of an electrospray emitter according to one example embodiment, given by way of example only.

FIG. 1 shows a schematic diagram in cross-section of an electrospray emitter 10. A single electrospray emitter 10 is shown although there may be many electrospray emitters formed on a single device. A liquid conduit 85 supplies liquid to be emitted into a channel 65, as shown by arrows C. The liquid conduit 85 may supply a single electrospray emitter 10, as shown in FIG. 1 or the liquid conduit 85 may supply many separate electrospray emitters 10 in communication with a the single liquid conduit 85. Furthermore, several separate liquid conduits 85 may be arranged to supply different liquid types to one or more electrospray emitters 10 on a single device.

An electric charge may be applied to the liquid by charging electrodes 80. These charging electrodes 80 may extend into the liquid conduit 85 or placed at another suitable location and they may be of various shapes such as conical, for instance. The charging electrodes 80 may be on one or any of the faces of the material forming the channels 85 or 65, through which the fluid flows. In particular, pointed charging electrodes 80 may be used to apply electric charge to the liquid, which may be conductive or non-conductive, as required.

The channel 65 is formed in a sheet or substrate 40 that may be formed of a suitable material such as for instance, silicon or plastics material (e.g. Kapton). A non-wetting or insulating layer 30 may be applied to the sheet 40. The non-wetting layer 30 may be a hydrophobic material such as FEP or other polyimide or other material resistant to wetting by the liquid. The non-wetting layer 30 may be chosen to repel to some extent any particular liquid to be electrosprayed including water and non-water based liquids. Therefore, the term wetting is not restricted to water. The non-wetting layer 30 prevents the aperture 55 in the channel 65 from becoming blocked with liquid or precipitate formed when the liquid evaporates or dries on the electrospray surface 75. As shown in FIG. 1, the non-wetting layer 30 surrounds the aperture 55 from which the liquid may be emitted from the apex 70 of a Taylor cone 60. Layer 30 may be an insulating layer instead of or as well as being a non-wetting layer.

The non-wetting layer 30 may be formed as a monolayer or thicker and may be a hydrophobic coating such as perfluorooctyltriethoxysilane (PFOTES), to provide easy cleaning and a meniscus of the emitted liquid so that it does no wet-over. Preferably, this layer may be between about 1 μm and 20 μm in thickness. For instance, the layer may be formed 12 μm thick. As a further example, non-wetting layer 30 may be formed from a photoresist material such as PTFE or similar materials.

The substrate 40 may be formed to provide sufficient stiffness for the device. For instance, the substrate may be a few 10 s of μm thick, such as 90 μm, preferably 40-50 μm or more preferably 25 μm thick. The substrate 40 may be formed from Kapton (by DuPont), for example.

A guard electrode layer 20 may be placed on top of the non-wetting layer 30 to prevent electrical cross-talk with other emitting channels that may be present on a multi-electrospray emitter, such as those that may be formed as an array or electrospray emitters 10. The non-wetting layer 30 may be exposed around the aperture 55, which forms a hydrophobic or liquid repelling ring 90 around the aperture 55. The guard electrode layer 20 may be absent in some embodiments. Where present, the guard electrode layer 20 may have a thickness under 5 μm and preferably 2-3 μm.

The liquid may be emitted from the aperture 55 of the channel 65 at an emitter surface 75. For a multi-electrospray emitter device, many apertures 55 may emit liquid from the emitter surface 75 simultaneously or according to a particular required pattern.

A control electrode 50 may be embedded within the sheet 40 and formed around the channel 65. The control electrode 50 may be separated from the channel 65 by a distance indicated by arrow B. Furthermore, the control electrode 50 may be enclosed within the electrospray emitter and separated from the emitter surface 75 by a distance indicated by arrow A'.

In the embodiment shown in FIG. 1, the control electrode 50 is in contact with the non-wetting layer and also covered by it. Alternatively, the control electrode 50 may be embedded within other layers of the electrospray emitter 10 or layers forming the sheet 40. Having the control electrode 50 separated from the emitter surface 75 facilitates easier cleaning and maintenance of the device and provides an exposed emitter surface 75 free from high voltage electrodes. However, the control electrode 50 may be exposed on the emitter surface 75 in alternative embodiments.

The control electrode 50 may control electrospray in the following way. A voltage may be applied to the charging electrodes 80 above a voltage that would enable electrospray to occur. However, applying a voltage of the same sign to the control electrode 50 could then prevent electrospraying from occurring. For instance, a voltage of 1800 V may be applied to the charging electrodes 80 and a voltage of 300 V may be applied to control electrode 50. Under these conditions and with a particularly configured emitter and liquid, electrospraying does not occur as the proximity of the energised control electrode 50 to the aperture 55 prevents emission. Reducing the voltage on the control electrode 50 to 0 V, for instance (or applying a negative voltage) may then allow electrospraying to commence. These are example voltages for a particular configuration and different arrangements may be used. Furthermore, various waveforms may be applied to the charging electrodes 80 and/or the control electrode 50 to provide different patterns of electrospraying. Different liquids having various different properties (e.g. viscosity) may require different voltages.

A constant voltage such as for instance, 300 V may be applied to the guard electrode 20 (preferably a conductor). This improves electrical isolation of the electrospray emitter from any nearby electrospray emitters that may be formed on the same sheet 40. Again, the voltage applied to the guard electrode may be varied to change the characteristics of the device.

Alternative embodiments may include changing the ratio of distance A' to B. Altering this ratio may avoid interaction with any surface that is receiving the electrosprayed liquid. Such receiving surfaces may be placed at various distances from the aperture 55, such as for instance 1-2 mm. For silicon-based devices, the electrodes may be formed from amorphous silicon or from a doping procedure. Insulating regions between electrodes may be formed from silicon oxide. Known patterning and etching techniques may be used to fabricate the electrospray emitter 10 or arrays of emitters.

Figure 1A:
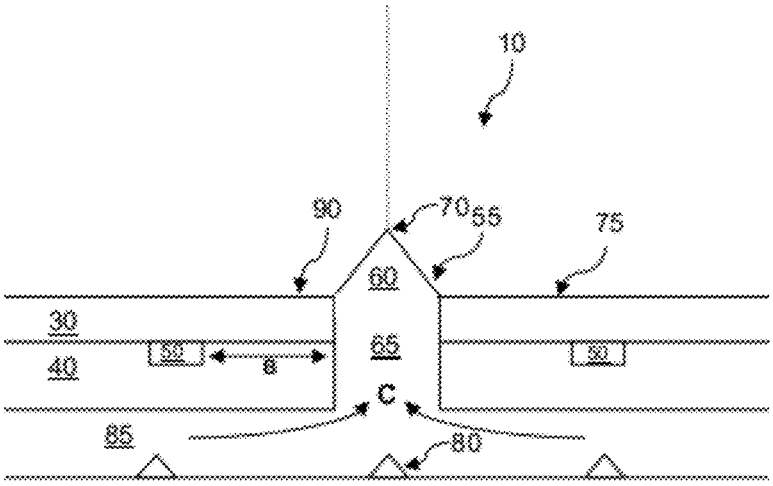
FIG. 1*a* shows a schematic diagram in cross-section of an electrospray emitter according to another embodiment.

FIG. 1*a* shows an alternative embodiment without the guard electrode layer 20. In this embodiment the non-wetting or insulator layer 30 is fully exposed. As a further alternative, the non-wetting or insulator layer 30 may be absent. In this case the control electrode 50 may be exposed, partially exposed or embedded within the sheet 40.

Figure 2:
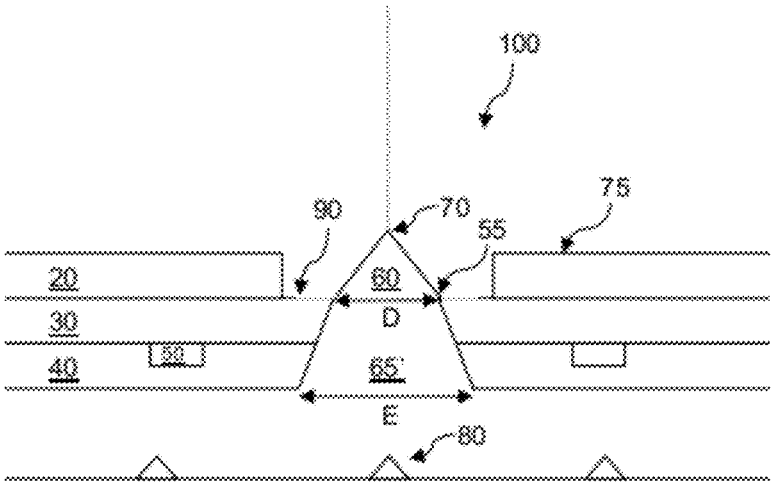
FIG. 2 shows a schematic diagram in cross-section of a further example embodiment.

FIG. 2 shows an alternative electrospray emitter 100. Similar features have been provided with the same reference numerals as those of FIG. 1 and shall not be described again. This embodiment is similar to that shown in FIG. 1 except that channel 65' through the sheet 40 and non-wetting layer 30 is tapered towards the aperture 55 in the emitter surface 75. Therefore, the channel 65' may be frusto-conical, for instance.

This tapering or narrowing of the aperture 55 provides improved high frequency electrospray emission (facilitated by a smaller aperture 55) whilst reducing hydraulic impedance to the flow of liquid through the channel 65' due to a wider opening or liquid supply entrance of the channel 65' from the liquid conduit 85. Although a tapered channel 65' is shown in FIG. 2, other structures of the channel 65' having a smaller aperture 55 diameter D than liquid supply entrance diameter E may also have benefits. As shown in FIG. 2, liquid passing into the channel 65 may be already charged by the charging electrode(s) 80, which is outside of the channel. However, the liquid charging electrode(s) 80 may alternatively be placed within the channel 65'.

Figure 3:
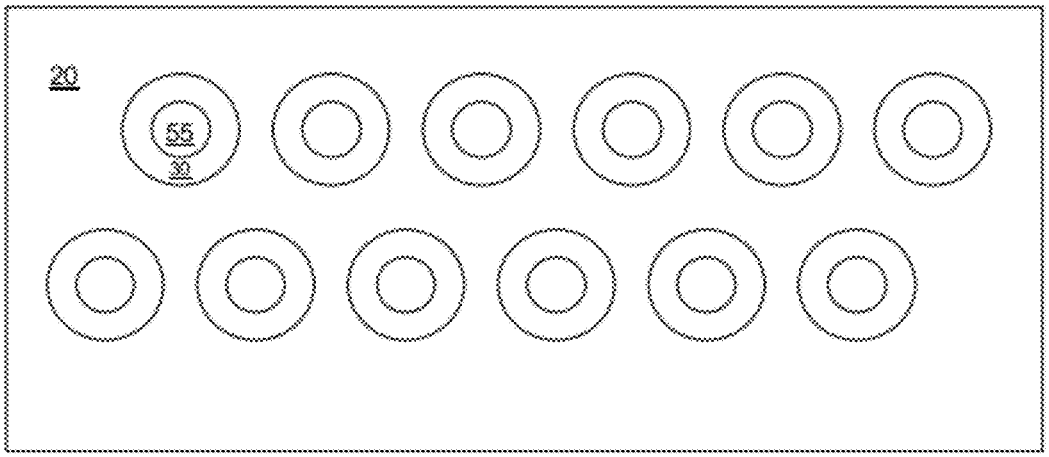
FIG. 3 shows a plan view of an array of electrospray emitters.

FIG. 3 shows a plan view of an array of the electrospray emitters shown in FIG. 1 or FIG. 2, as viewed from the emitter surface 75. The guard electrode 20 extends across the emitter surface 75 in this example. However, the non-wetting surface 30 may be exposed around each aperture 55 and is otherwise covered by the guard electrode 20. The apertures 55 through the sheet 40 are formed in rows that may be staggered to improve resolution of droplets of liquid on a receiving surface. However, other array configurations may be used. Electrical connections are not shown in this figure.

Figure 4:
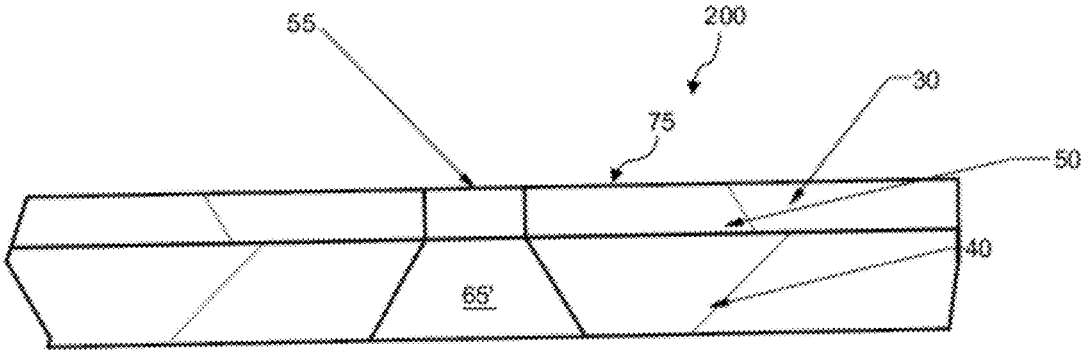
FIG. 4 shows a schematic diagram in cross-section of a further example embodiment.

FIG. 4 shows a schematic diagram in cross-section of a further example electrospray emitter 200. This figure is drawn to scale. Channel 65' in this example, is frusto-conical or tapered. However, the control electrode 50 is flush with the emitter surface 75 and open to the environment and is formed up to the edge of the aperture 55. Furthermore, the control electrode is level with the non-wetting layer 30. The liquid conduit is not shown in this figure. However, liquid may be introduced into channel 65' from the liquid supply entrance. The thickness of the non-wetting layer 30 (in this example FEP) is 12.5 μm and suitable dimensions of the other features may be derived from this scale drawing showing this particular example device. FIG. 4 may be used with non-conductive fluids and have tapered or non-tapered channels.

Figure 5:
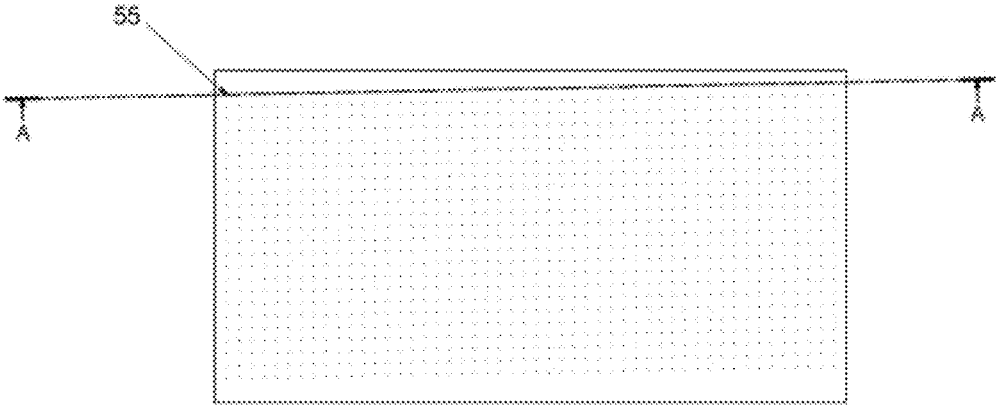
FIG. 5 shows a plan view of an array of the electrospray emitter of FIG. 4.

FIG. 5 shows a plan view of an array of electrospray emitters 10. Apertures 55 are shown in rows and columns, one of which is indicated by line A-A. The rows of electrospray emitters 10 are staggered to allow electrical connections to be placed between individual electrospray emitters 10.

Figure 6:
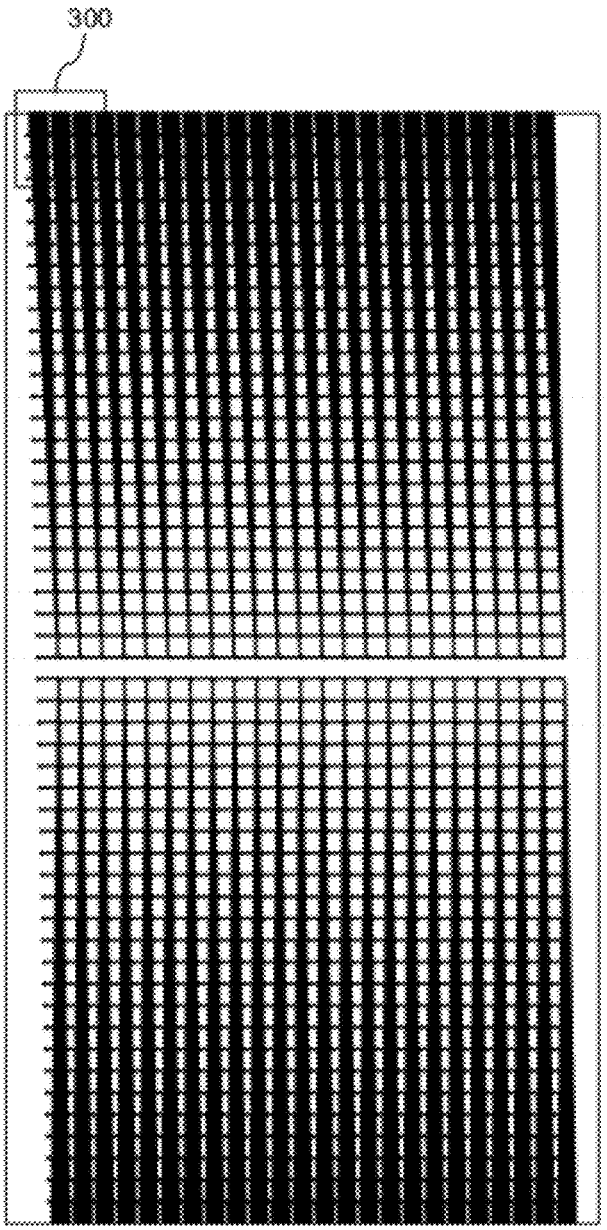
FIG. 6 shows a plan view of an array of electrospray emitters including the layout of electrodes.

FIG. 6 shows the structure of electrical connections on the surface of an array of electrospray emitters 10, or embedded within such a device. Each electrical connection allows individual electrospray emitters 10 to be separately or independently controlled. A small portion of the device is highlighted as area 300.

Figure 7:
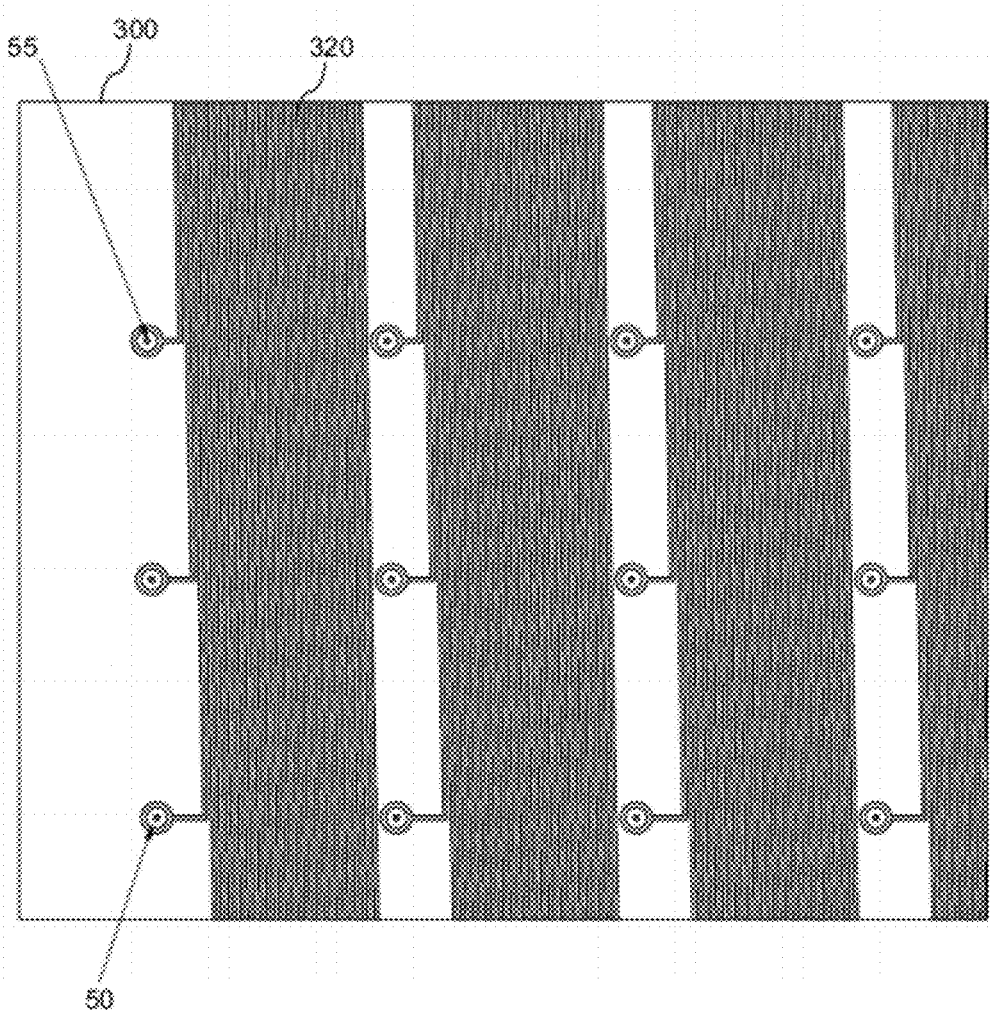
FIG. 7 shows an enlarged view of a portion of the plan view of electrospray emitters shown in FIG. 6.

FIG. 7 shows a magnified view of area 300 of FIG. 6 and contains twelve individual electrospray emitters 10, each having an aperture 55.

The electrical connections 320 shown in FIG. 7 connect to each control electrode 50. These electrical connections 320 are arranged as a raster pattern between the electrospray emitters 10. The electrical connections 320 and control electrodes 50 may be located on the emitter surface 75 or embedded within the device.

Figure 8:
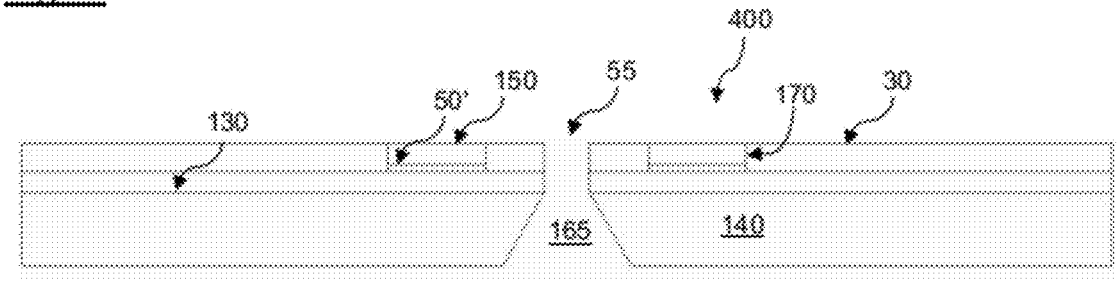
FIG. 8 shows a schematic diagram in cross-section of a further example embodiment.
Figure 9:
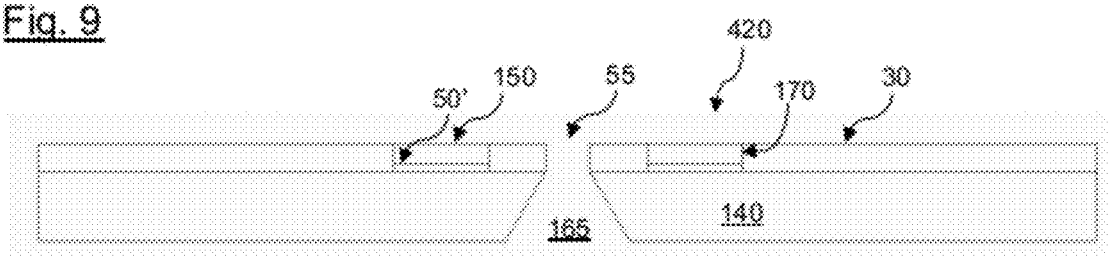
FIG. 9 shows a schematic diagram in cross-section of a further example embodiment.
Figure 10:
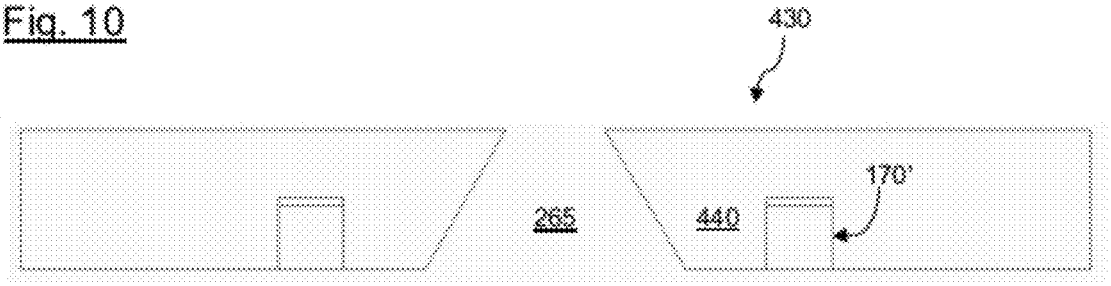
FIG. 10 shows a schematic diagram in cross-section of a further example embodiment.

FIGS. 8-10 show schematic diagrams of example electrospray emitters that may be manufactured using embossing, casting and/or injection moulding techniques. FIG. 8 shows a schematic cross-sectional diagram of part of a further example electrospray emitter 400. In this example, the non-wetting layer is formed from two layers of FEP 30, 130 laminated onto a Kapton substrate 140. Alternatively, a single layer of FEP or other non-wetting material may be used.

Once the laminated structure is formed, the aperture 55 may be embossed through the non-wetting layer(s) 30, 130. A groove 170 may be formed through the top non-wetting layer 30 or in the case of a single non-wetting layer, partially through this layer. In the cross-sectional view of FIG. 8, this groove 170 is in the form of a ring. The groove may be extended to communicate with other emitters in an array. A metal layer 50' in the bottom of the groove 170 may be introduced (e.g. by evaporation) to form the control electrode. The metal layer 50' in groove 170 may be embedded by filling the remaining portion of the groove 170 with a suitable filler such as a photoresist (e.g. SU8). A channel 165 may be produced to communicate with the aperture 55 by laser ablation from the underside (from the bottom, as shown in FIG. 8). Laser ablation may be used to form a conical channel 165.

FIG. 9 shows a schematic cross-sectional diagram of part of a further example electrospray emitter 420. This example has a similar structure to that described with reference to FIG. 8. However, both the aperture 55 and groove 170 in this example, are formed by embossing through the non-wetting layer 30 (e.g. FEP) to the surface of the substrate 140 (e.g. Kapton) i.e. to the interface between these two layers. Therefore, this example depends more on the integrity of the interface (e.g. FEP/Kapton) to prevent electrical breakdown but is easier to manufacture.

FIG. 10 shows a schematic cross-sectional diagram of part of a further example electrospray emitter 430. In this example the substrate and non-wetting layer are combined as a single sheet material of FEP 440. The groove 170' is instead formed (e.g. by embossing) from the underside, i.e. opposite the electrospray surface (lower part, as shown in FIG. 10). Furthermore, the aperture and channel 265 are formed in a single embossing step that may be combined with the embossing step to form the groove 170'. The channel/aperture 170' is shown as conical in this figure but may alternatively have straight sides. Alternatively, the groove 170 may be formed on the same side as the electrospray surface. In either case, a metal layer 50' in the bottom of the groove 170 may be introduced (e.g. by evaporation) to form the control electrode. The metal layer 50' in groove 170 may be embedded by filling the remaining portion of the groove 170 with a suitable filler such as a photoresist (e.g. SU8).

In the examples shown in FIGS. 8-10, a liquid conduit 85 may be formed between the electrospray parts shown in these figures and a manifold (not shown in these figures). This liquid conduit 85 may communicate with the channel 165, 265 to supply liquid to the electrospray emitter 400, 420, 430. This manifold may take the form of a plate or cover separated from the substrate 140 forming the liquid conduit 85.

Advantages of the examples shown in FIGS. 80-10 over the previous examples, i.e. laminar construction devices include: The control electrode 50' may be embedded within the device, making it more resistant to electrical breakdown. This allows the control electrodes 50' to be placed closer to the aperture 55, which will reduces the voltage required to produce a sufficient electric field. This also simplifies the required drive electronics. The laminar examples may be more susceptible to breakdown at interfaces between layers. In the embedded examples there are no interfaces connecting the electrode to the fluid.

Manufacture of the examples shown in FIGS. 8-10 may be further simplified. These devices may be made from a non-wetting fluoroplastic material (e.g. FEP or similar). The laminar examples may incorporate a layer of FEP and a layer of Kapton (or other substrate material)—these two material types may require different processes to produce the aperture 55 and channel 65. For instance, laser cutting FEP may be difficult. However, laser cutting of Kapton may be straightforward.

Making the device using an embossing, casting or injection moulding technique provides several additional advantages:

Electronic tracks (especially used in arrays of electrospray emitters) may be formed as grooves 170—these may be metallised (e.g. by evaporation) and filled with another high breakdown material (such as SU8 resist). Any metal on the top surface may then be etched away to leave the desired pattern. This reduces the need to pattern the electrodes by photolithography, which may be a more expensive and complicated process.

The aperture 55 may be defined by a mould and therefore improve the definition of the aperture 55 shape. These advantages may simplified production and increase quality and yield.

Figure 11:
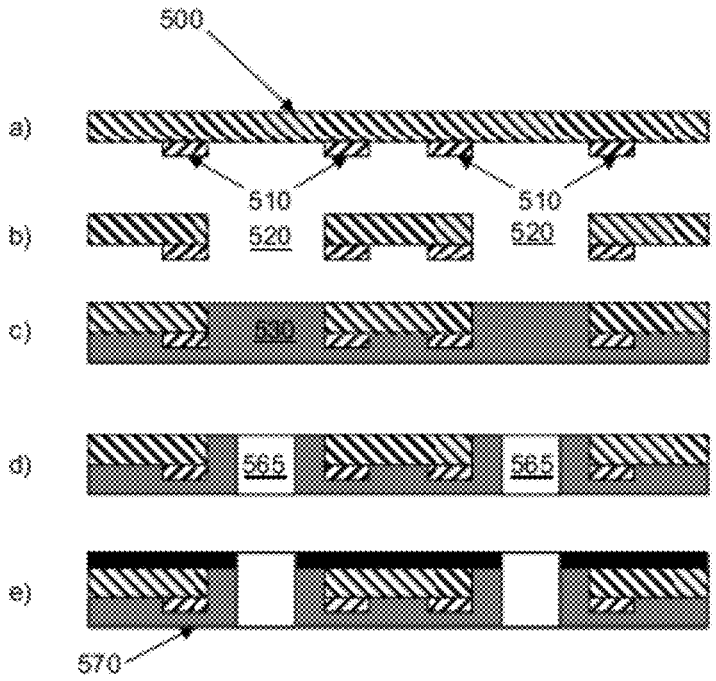
FIG. 11(*a-e*) shows a series of schematic diagrams in cross-section illustrating a method of manufacturing an electrospray emitter.

FIG. 11 shows a schematic diagram of steps (a-e) of a method of manufacturing an array of electrospray emitters. In step a, a circuit 510 is patterned on a substrate 500 (for example Kapton) using photolithography. Holes or bores 520 are drilled through the substrate 500 using a laser drill (or other drill) at step b. A photoresist (such as SU8) 530 is applied to the substrate 500 and fills or partially fills the laser drilled holes 520 (step c). Nozzles or channels 565 are etched through the photoresist 530 using lithographic techniques (step d). This provides a finer tolerance to the bore than the laser drilling at step b.

An optional non-wetting layer 570 may be applied around the openings or apertures in the channels 565 (step e). For non-conductive liquid or ink, a metal coating may be applied to the inside surface of the channel 565.

Figure 12:
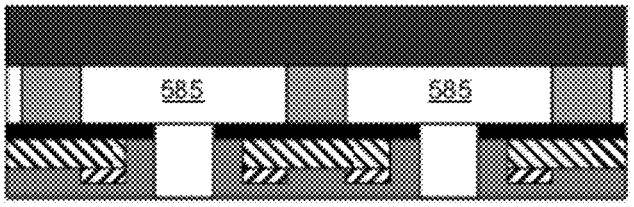
FIG. 12 shows a schematic diagram in cross-section of an electrospray emitter formed from the method of manufacture shown in FIG. 11(*a-e*)

FIG. 12 shows a schematic diagram of a resultant assembled device complete with liquid manifold 585. Electrical connections are not shown in this figure.

Figure 13:
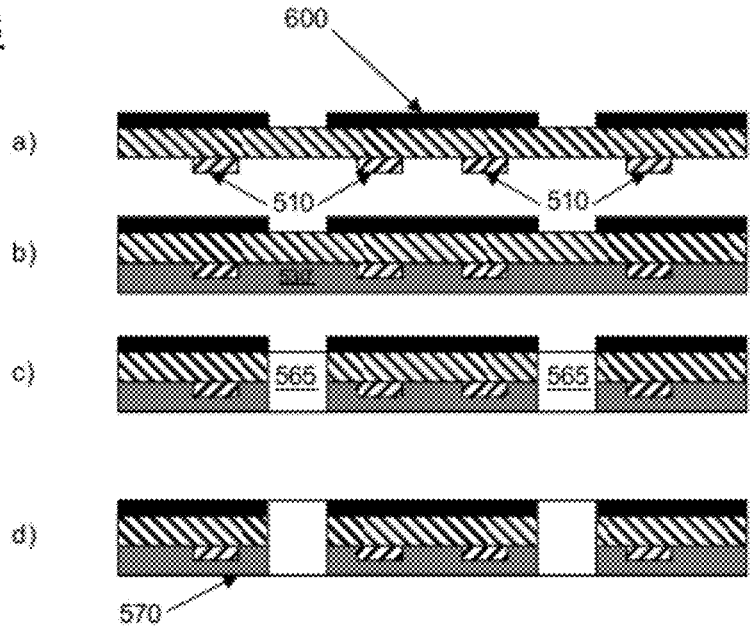
FIG. 13(*a-d*) shows a series of schematic diagrams in cross-section illustrating an alternative method of manufacturing an electrospray emitter.

FIG. 13 shows a schematic diagram of steps (a-d) of a further method of manufacturing an array of electrospray emitters. In step a, a circuit 510 is again patterned on a substrate 500 (for example Kapton) using photolithography. A further circuit, features or mask 600 may be patterned on the opposite side of the substrate 500 during this process. A photoresist (such as SU8) or other polymer layer 530' is applied to the substrate 500 without any holes or bores being drilled. Nozzles or channels 565 are ablated (e.g. by laser ablation) through the layer 530' and substrate 500 using the circuit or features 600 as a mask. This ablation defines the size and position of the channels 565.

An optional non-wetting layer 570 may be applied around the openings or apertures in the channels 565 (before or after the ablation step) at step d.

Figure 14:
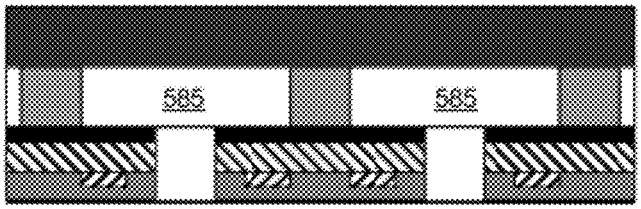
FIG. 14 shows a schematic diagram in cross-section of an electrospray emitter formed from the method of manufacture shown in FIG. 13(*a-d*).

FIG. 14 shows a schematic diagram of a resultant assembled device complete with liquid manifold 585. Electrical connections are not shown in this figure.

The circuits 510 of both methods may be an internal electrode layer of the device.

Many combinations, modifications, or alterations to the features of the above embodiments will be readily apparent to the skilled person and are intended to form part of the invention.

As will be appreciated by the skilled person, details of the above embodiment may be varied without departing from the scope of the present invention, as defined by the appended claims.

For example, the relative thicknesses and dimensions the layers may be altered. The sheet may be a semiconductor substrate such as silicon. The channels of any embodiment may be tapered or non-tapered.

The emitter surface does not need to be flat and may instead by smooth or featureless or absent protrusions. The emitter surface does not need to extend over the entire sheet but may extend at least partially over the sheet or a portion of the sheet. The sheet may be but does not need to be planar.

An underlying electrode support structure layer may contain embedded control electrodes 50. This electrode support structure may form all or part of the substrate 40 and may be a few 10 s of μm thick. A design requirement affecting this dimension may be the required stiffness of the layer for mechanical stability. A guard electrode 20 may further add mechanical stability. In one example, two components may form the electrode support structure: a 30 μm thick Kapton layer, which does not have embedded electrodes and a separate PCB layer structure having a thickness of ~90 μm. The thickness of embedded electrodes 50 may be a few μm, e.g. ~5 μm and in one example, the thickness is 38 μm.

The aperture may have a dimension in the range of 10 s of μm. Preferably, they may be in the range 30 μm to 50 μm in diameter, but may also be as large as 100 μm, for example. Optionally, the system could operate with an aperture diameter as low as ~4 μm, however such small diameter apertures may be subject to blockage.

The diameter of the control electrode 50 may be dependent on the pitch of an array of electrospray emitters 10. The control electrode 50 may have a minimum diameter compatible with being larger than the aperture 55 of the electrospray emitter 10, whilst preventing discharge through the non-conducting electrode support structure or substrate 40.

For example, 400 μm diameter control electrodes 55 having an electrode width of 100 μm, may be used. In the higher pitch density electrospray arrays, the electrode diameter may instead be ~20 μm larger than the aperture 55, e.g. 50 to 70 μm in diameter. Control electrode 55 width may be in the range 10 to 20 μm, for example.

Fluid properties may be similar to those that we have identified in the applicant's earlier applications (i.e. EP06820456.9 and EP08750639.0). Fluids that have been tested have the properties shown in table 1.

TABLE 1

| Property | Values | | | | |
|---|---|---|---|---|---|
| Conductivity S/m | 9.70E−02 | 1.00E−4 | 9.40E−02 | 5.90E−4 | 1.00E−6 |
| Surface Tension N/m | 0.0373 | 0.0337 | 0.034 | 0.0388 | 0.0388 |
| Viscosity cpoise or mPa · s | 11.2 | 116 | 96 | 12.1 | 11 |

The invention claimed is:

1. An array of electrospray emitters for emitting a liquid comprising:

a sheet having a plurality of channels opening to a flat emitter surface to form a plurality of apertures, the flat emitter surface extending across the sheet;

a charging electrode coupleable to an electrical supply and arranged in direct contact with liquid passing into the plurality of channels to apply an electrical charge to the liquid; and a control electrode corresponding to each channel, each control electrode coupleable to the electrical supply, and each control electrode embedded in the sheet so as to be proximal to but separated from the corresponding channel, the control electrode configured to control electrospray emission from the flat emitter surface, wherein the flat emitter surface remains flat during electrospray emission;

wherein the electrical supply provides voltages to the charging electrode and the control electrode, and the charging electrode and the control electrode are configured to:

apply a voltage of the same polarity to both the charging electrode and the control electrode to prevent electrospray of the liquid, and apply a voltage of the opposite polarity to both the charging electrode and the control electrode to result in electrospray of the liquid, or apply a non-zero voltage to the charging electrode and apply a zero voltage to the control electrode to result in electrospray of the liquid.

2. The array of electrospray emitters of claim 1, wherein the control electrode is separated from the emitter surface.

3. The array of electrospray emitters of claim 1, wherein the control electrode at least partially surrounds the channel.

4. The array of electrospray emitters according to claim 1, further comprising a non-wetting layer, at least a portion of a surface of the non-wetting layer forming at least a portion of the emitter surface extending across the sheet.

5. The array of electrospray emitters of claim 4, wherein the non-wetting layer is a fluoropolymer material.

6. The array of electrospray emitters according to claim 1, further comprising a guard electrode, at least a portion of a surface of the guard electrode forming at least a portion of the emitter surface.

7. The array of electrospray emitters of claim 6, wherein the guard electrode surrounds each of the plurality of channels.

8. The array of electrospray emitters of claim 7, further comprising a non-wetting layer on the emitter surface of the sheet, wherein the non-wetting layer is between the guard electrode and the sheet and further wherein the non-wetting layer is exposed around each of the plurality of apertures.

9. The array of electrospray emitters according to claim 1, wherein each of the plurality of channels tapers towards an aperture of the plurality of apertures on the emitter surface.

* * * * *